US005536113A

United States Patent [19]

McGregor

[11] Patent Number: 5,536,113

[45] Date of Patent: Jul. 16, 1996

[54] PRECAST CONCRETE WINGWALL

[75] Inventor: James R. McGregor, Cincinnati, Ohio

[73] Assignee: North Star Concrete of Ohio, Inc., Cincinnati, Ohio

[21] Appl. No.: 243,246

[22] Filed: May 16, 1994

[51] Int. Cl.[6] ..... E02D 5/20; E01F 5/00

[52] U.S. Cl. ..... 405/125; 405/286

[58] Field of Search ..... 405/124, 125, 405/126, 286, 285, 284; 52/295, 610, 745.21, 79.14

[56] References Cited

U.S. PATENT DOCUMENTS

| | | | |
|---|---|---|---|
| 1,778,574 | 10/1930 | Thornley | 405/286 |
| 2,413,867 | 1/1947 | Easterday | 405/286 |
| 3,779,021 | 12/1973 | Green | 405/125 |
| 4,067,166 | 1/1978 | Sheahan | 405/284 X |
| 4,993,872 | 2/1991 | Lockwood | 405/125 |

*Primary Examiner*—Stephen J. Novosad
*Attorney, Agent, or Firm*—Biebel & French

[57] ABSTRACT

A precast concrete soil retaining structure is provided comprising an upright portion, a base portion, and a plurality of retaining caps. Preferably its use will be as a wingwall for use with culvert systems. The upright portion of the structure has a first face and a second face, as well as a first end and a second end. The first end is of a height greater than or equal to the height of the second end. The base portion has a top surface and a bottom surface and a plurality of channels of a first diameter, each of which extends between the top surface and the bottom surface. Each of the retaining caps has a channel of a second diameter extending therethrough, with the second diameter preferably being less than that of the first diameter. Each of the retaining caps is positioned above a respective one of the base portion channels.

20 Claims, 3 Drawing Sheets

PRECAST CONCRETE WINGWALL

FIELD OF THE INVENTION

This invention is directed to the providing of an improved precast concrete soil retaining wall structure, and more particularly to an improved precast concrete wingwall for use with concrete culvert systems.

BACKGROUND OF THE INVENTION

Where a stream is to pass under a roadway, there are generally two alternatives which may be employed to permit the stream to pass under the roadway. The first is the construction of a bridge which spans the stream. This can be extremely expensive, especially in applications where the culvert to be crossed is relatively narrow. The other alternative is the use of concrete culvert systems. These systems typically utilize precast concrete culvert sections which are placed adjacent one another until they extend essentially the width of the road to pass over the culvert. At the opposing ends of the aligned sections are placed respective pairs of concrete wingwalls which can assist with the controlling of water flow beneath the culvert and to prevent the erosion of the ground near the ends of the aligned culvert sections. On each side of the culvert is a concrete footer on which the aligned culvert sections and wingwalls rest.

Typically the wingwalls associated with the prior art have not been precast. Instead a contractor pours cast-in-place wingwalls following the alignment of the precast culvert sections. To retain the wingwall atop a footer, a series of steel reinforcing rods extend upwardly into the upright portion of a wingwall, which portion is known as the "stem", about 3'. However, utilizing cast-in-place wingwalls typically consumes one to two weeks of additional construction time, with this time associated with the pouring and curing of the four wingwalls.

Additionally, since it is necessary to exhibit control over the curing process, problems can arise concerning the quality control associated with the wingwalls in the event there are any problems with the culvert system over time. Further, weather can present a problem where the wingwalls are cast-in-place, especially in parts of the country which experience extremely low temperatures.

Because of concerns over quality control, a precast wingwall has recently become available and is disclosed in U.S. Pat. No. 4,993,872. The wingwall associated with that patent is physically attached to the end-most culvert sections at opposite ends of the culvert system. Additionally, in an attempt to limit movement of that wingwall, a thrust block is utilized. Both the physical attachment of the wingwall to the culvert section the utilization of a thrust block highlight the extreme desirability of preventing the wingwall from moving from its original placed position.

However, a problem with precast concrete wingwalls which are physically secured to an end-most culvert section is that any settling problems associated with the footer near the wingwall can impart substantial forces on the retention means securing the wingwall to the end-most culvert section. These forces may precipitate the failure of the culvert section-wingwall attachment, resulting in settlement of the wingwall. This instability of the wingwall can result in undesirable movement, perhaps in total collapse of the wingwall, thereby necessitating significant repair to the culvert assembly. Therefore, it would be desirable to utilize a precast concrete wingwall not suffering from any of the disadvantages associated with the prior art.

SUMMARY OF THE INVENTION

In accordance with the present invention, a precast concrete wingwall is provided having an upright portion, a base portion, and a plurality of retaining caps. The upright portion has a first face and a second face. The base portion has a top surface and a bottom surface, and a plurality of channels of a first diameter extending between said the top surface and the bottom surface. The plurality of retaining caps each has a channel of a second diameter which extends therethrough. Each of the retaining caps is positioned above a respective one of the base portion channels.

Furthermore, the first diameter associated with the base portion channel is preferably greater than the second diameter associated with the retaining cap channels. Preferably the base portion channel is filled with a first substance, such as a cement grout, while the retaining cap channel is filled with a second substance such as epoxy resin.

The upright portion of the wingwall has a first end and a second end with the first end preferably being of a height greater than the second end. The wingwall also includes an intermediate surface known as a haunch which slopes upwardly from the base portion top surface to the second face of the upright portion.

There is also disclosed a precast concrete structure preferably for use with a footer having a support portion, a raised portion and a footer sidewall, the support portion having an upper surface and steel reinforcing rods extending upwardly therefrom, and the raised portion having an upper surface, with the footer sidewall extending upwardly from the support portion to the raised portion, and with the structure comprising an upright portion, a base portion, and a plurality of retaining caps. The upright portion has a first face and a second face. The base portion has a top surface and a bottom surface with a plurality of channels of a first diameter extending between the top surface and the bottom surface. The plurality of retaining caps each has a channel of a second diameter extending therethrough. Each of the retaining caps is positioned above a respective one of the base portion channels.

The base portion channel first diameter is preferably greater than the retaining cap channel second diameter. Preferably the base portion channel is filled with a cement grout, while the retaining cap channel is filled with an epoxy resin.

The upright portion of the wingwall has a first end and a second end, with the first end preferably being of a height greater than that of the second end. One each of the reinforcing rods extend through each base portion channel and retaining cap channel. Preferably the wingwall also includes an intermediate surface which slopes upwardly from the base portion top surface to the second face of the upright portion. Also, preferably the first face is located adjacent the footer sidewall which extends upwardly from the wingwall support portion.

There is also disclosed in combination a precast concrete wingwall and a footer. The footer comprises a wingwall support portion, a raised portion, and a footer sidewall. The wingwall support portion has an upper surface and a plurality of reinforcing rods extending upwardly therefrom. The raised portion has an upper surface with the footer sidewall extending upwardly from the wingwall support portion to the raised portion. The wingwall comprises an upright portion having a first face and a second face, a base portion having a top surface and a bottom surface, a plurality of channels of a first diameter extending between the top surface and the bottom surface, and a plurality of retaining caps each having a channel of a second diameter extending therethrough, each of the retaining caps positioned above a respective one of said base portion channels.

Preferably the base portion first diameter is greater than the retaining cap channel second diameter. Additionally, the base portion channel is preferably filled with cement grout while the retaining cap channel is preferably filled with epoxy resin. The upright portion has a first end and a second end, with the first end being of a height greater than the second end. The primary objective of this invention is to provide a precast concrete end wall which is easy to install and is capable of being retained in fixed relationship to the remainder of a concrete culvert system. An important aspect of this invention is to minimize the potential shifting of a wingwall due to consideration of settling. These and other objects and advantages of this invention will be readily apparent from the following detailed description of an illustrative embodiment thereof. Reference will be had to the accompanying drawings which illustrate the embodiment of the invention.

DESCRIPTION OF THE ILLUSTRATIVE EMBODIMENT

Figure 1:
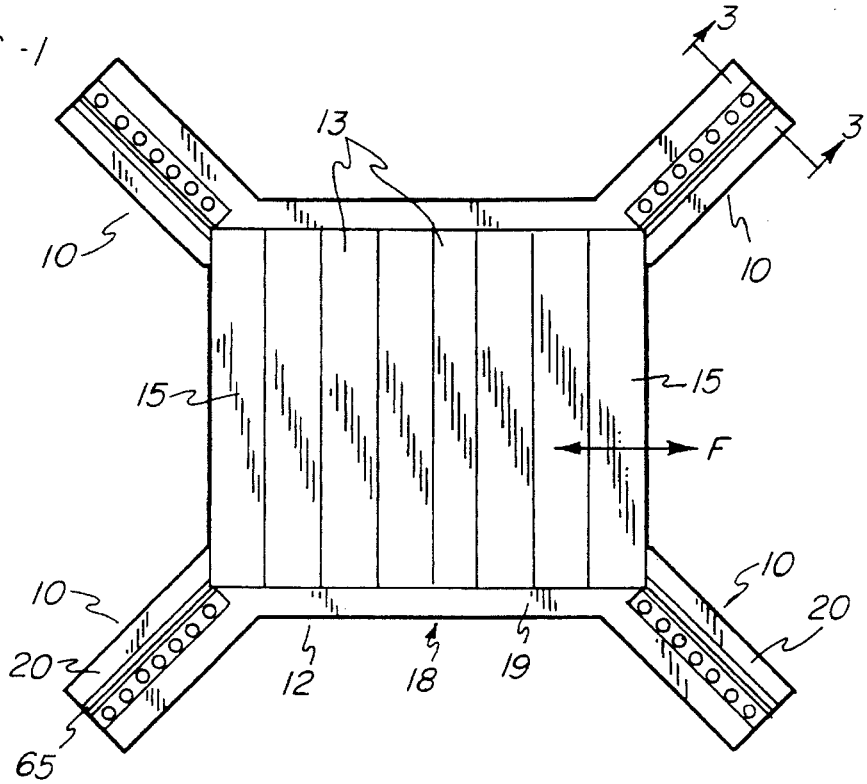
FIG. 1 is a top plan view showing a concrete culvert system.

Having reference to the drawings, attention is directed first to FIG. 1 which illustrates the four wingwalls used in conjunction with a concrete culvert system. The wingwall of this invention is designated generally by the numeral 10. The culvert system 12 with which the wingwalls 10 are used is formed from a plurality of culvert sections. These culvert sections have a top surface and two downwardly depending parallel walls having an inner and outer surface. Culvert sections 13 are placed adjacent one another so as to span a stream flowing in a direction F or other desired physical formation. At the outermost edges of the culvert system 12 are a pair of end sections 15. As can be seen from FIGS. 1 and 2, one pair of the wingwalls 10 are placed directly adjacent each end-most section 15. The angular relationship between a wingwall and the end-most section directly adjacent thereto will vary depending on the topography.

The entire culvert system including wingwalls is supported on a pair of concrete footers 18, with one each of the footers being on opposite sides of the culvert. These footers 18 are preferably formed from poured concrete at the installation site. Each footer 18 has a central section 19, the length of which corresponds to the approximate width of the road, and two wingwall sections 20 disposed at opposite ends of the central section 19.

The footer design takes into account soil engineering and hydraulic considerations. The central section, formed from poured concrete, in the preferred embodiment of this invention is approximately 6' wide and 3'3" deep. Down the center of the central section 19 is a trough which is approximately 3" deep and 1'2" wide. The end walls of the culvert sections 13 are placed into the center section's trough which aids in stabilizing them and effectively precludes their shifting over time. The wingwall sections 20 of footer 18 are approximately 8' wide and 21' long. As can best be appreciated by a comparison of FIGS. 1, 2 and 3, wingwall section 20 includes a wingwall support portion 22 having an upper surface 23, and a raised portion 24 having an upper surface 25. The width of the upper surface 25 of the raised portion 24 is 2'. A sidewall 27 extends upwardly from the upper surface 23 of the wingwall support portion 22 of the wingwall section 20 and terminates at the upper surface 25 of the raised portion 24 of wingwall section 20. The wingwall section also has a pair of edge walls 28 and 29. The height of edge wall 28 is approximately 1' while the height of edge wall 29 is approximately 1'3", such that the height of sidewall 27 can be appreciated as being 3". The wingwall section 20 of each footer 18 also has a footer end wall 30.

Each actual wingwall 10 is comprised of an upright portion or stem 40 and base portion 42. As can be appreciated from a comparison of FIGS. 2, 3, 4 and 5, the stem 40 has a top edge 45, a first face 47, and a second face 49. Meanwhile, the base portion 42 has a top surface 52, a bottom surface 54, and a sidewall 56 which extends longitudinally along wingwall 10. The distance between first face 47 and second face 49 is approximately 9". The height of sidewall 56 is approximately 1'. The width of the bottom of the bottom surface 54 is approximately 3'6".

Each wingwall also has a first end 58 and a second end 60. First end 58 is preferably of a height greater than that of second end 60, although in some applications the structure of the instant invention may have both heights being equal. First end 58 is placed directly adjacent the end section 15, such that the top edge 45 in the preferred embodiment slopes downwardly away from its junction of the first end 58 and the end section 15. In the preferred embodiment, the height of the second end 60 is approximately 2' while the height of the first end 58 is approximately 13'6" or less.

Sloping upwardly from the top surface 52 of base portion 42 to the second face 49 of upright portion 40 is haunch 65. Although the haunch 65 is shown as being planar, it could be either concave or convex. Its presence is due to the structural steel within the precast concrete wingwall as will be discussed below.

A unique aspect of this invention is the presence of a plurality of retaining caps 70, each of which has an upper surface 72, a side surface 74, a base surface 76 and a lower surface 78 in the preferred shape of retaining cap. As can best be seen from a comparison of FIGS. 3 and 4, the upper surface 72 is preferably the planar top surface of the cap, while the lower surface 78 is the underside or bottom surface of the cap. Extending essentially vertically upwardly from the lower surface 78 in the preferred embodiment of the invention is the base surface 76. In the preferred embodiment of the invention, the lower surface 78 is 18" in diameter and the base surface 76 extends upwardly 2". Meanwhile, the upper surface 72 is preferably a circle having a 6" diameter.

Sloping upwardly from the top of the base surface 76 to the upper surface 72 is the side surface 74. In the preferred embodiment of the invention this surface is planar as can be seen from the drawings. However, the shape of the retaining cap could be more dome-like or could be configured in other geometric configurations. Extending downwardly through the retaining cap 70 from its upper surface to its lower surface is a cylindrical cap channel 80. Similarly, extending downwardly through the base portion 42 of each wingwall are a plurality of cylindrical base channels 82. Preferably there will be one retaining cap and cap channel for each base channel 82. Thus, in viewing FIGS. 1, 2 and 4 it will be noted that there are seven retaining caps associated with each wingwall and thus seven cap channels and seven base channels 80 and 82 respectively. Thus it can be appreciated for wingwalls having seven base channels 82 the center line of each base channel is spaced approximately 2' from each other.

Within the poured concrete of each wingwall section 20 are a plurality of reinforcing rods 85, preferably formed of steel. The number of reinforcing rods corresponds to the number of base channels in the adjacent wingwall. Thus, in each footer associated with the drawing figures, there are seven reinforcing rods. These reinforcing rods 85 have a base portion 86 which extends generally horizontally within the wingwall section 20 of the footer. There is also an upright portion 88 of the reinforcing rod which extends generally vertically through the footer and projects approximately 1'10" above upper surface 23, far less than the 3' reinforcing rod associated with the prior art. The reinforcing rod is preferably coated with an epoxy coating to inhibit rust.

Figure 2:
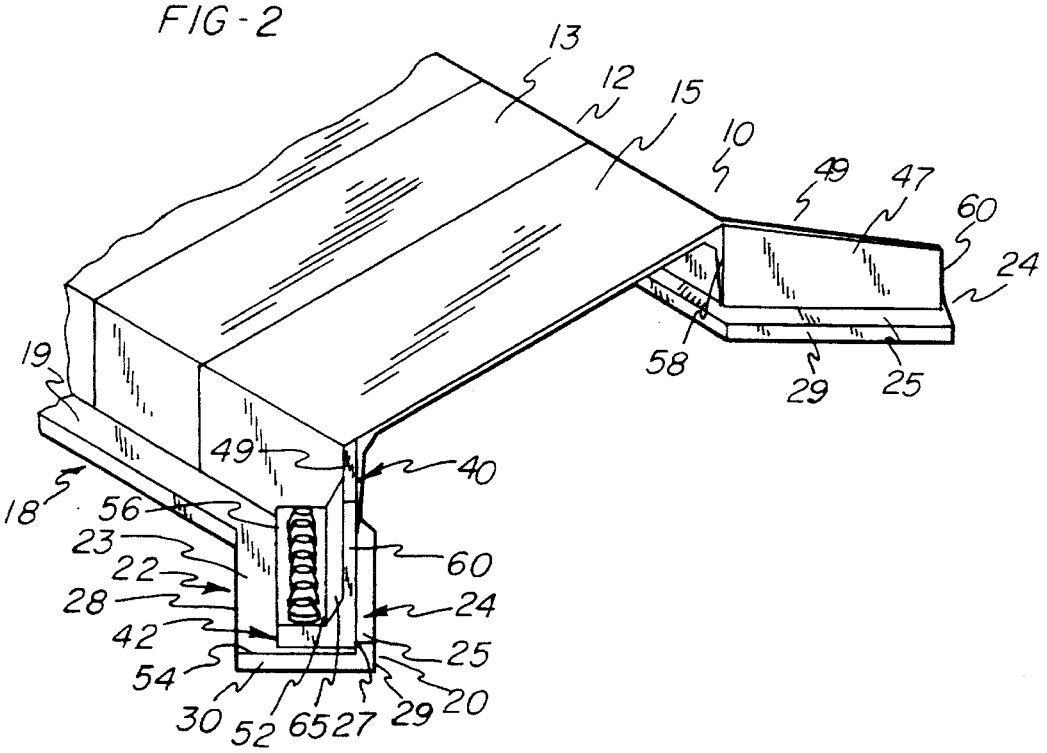
FIG. 2 is a perspective view of one end of a concrete culvert system which discloses the relative positioning of two of the wingwalls.
Figure 3:
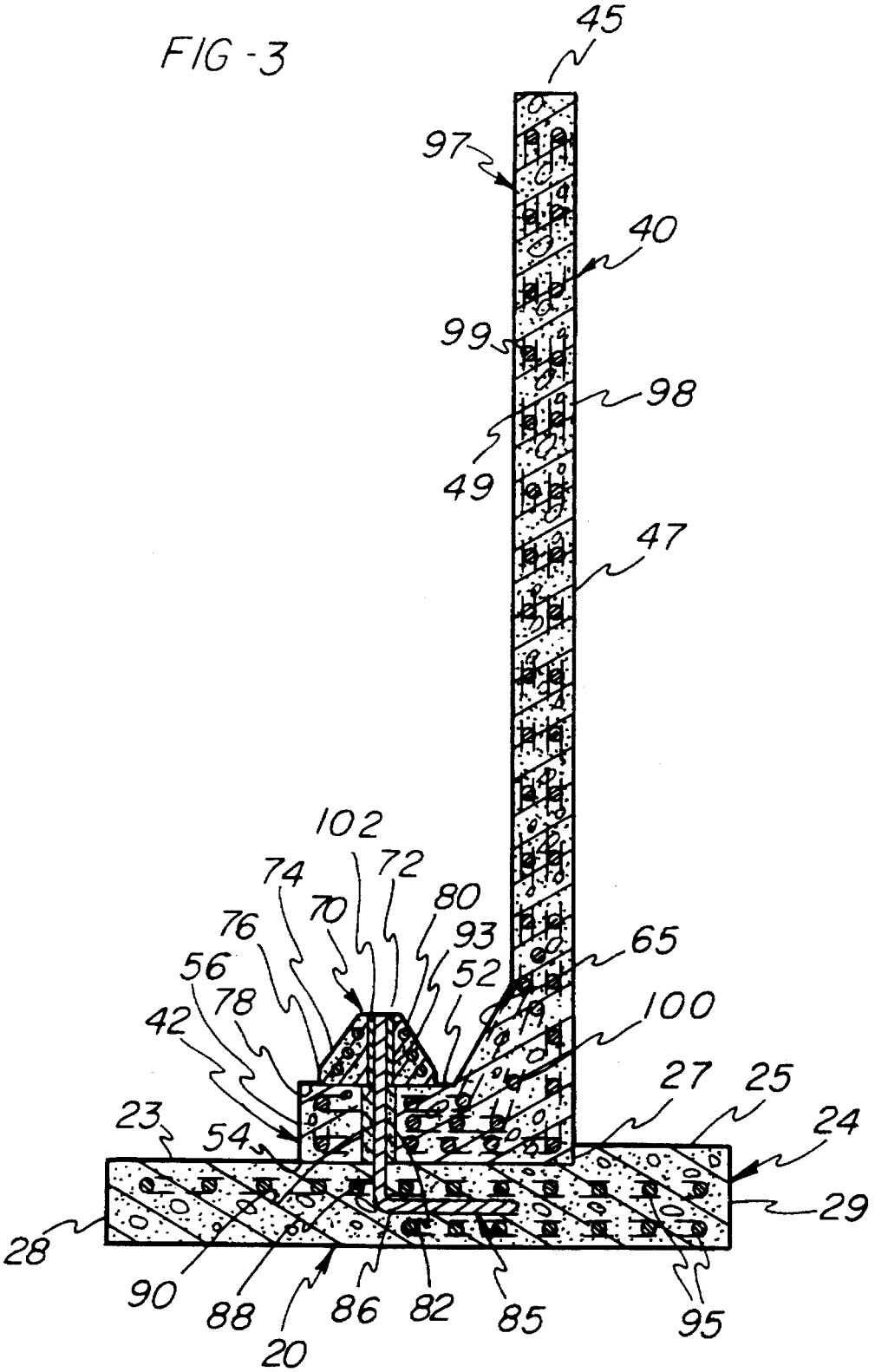
FIG. 3 is a vertical sectional view taken on an enlarged scale along line 3—3 of FIG. 1.
Figure 4:
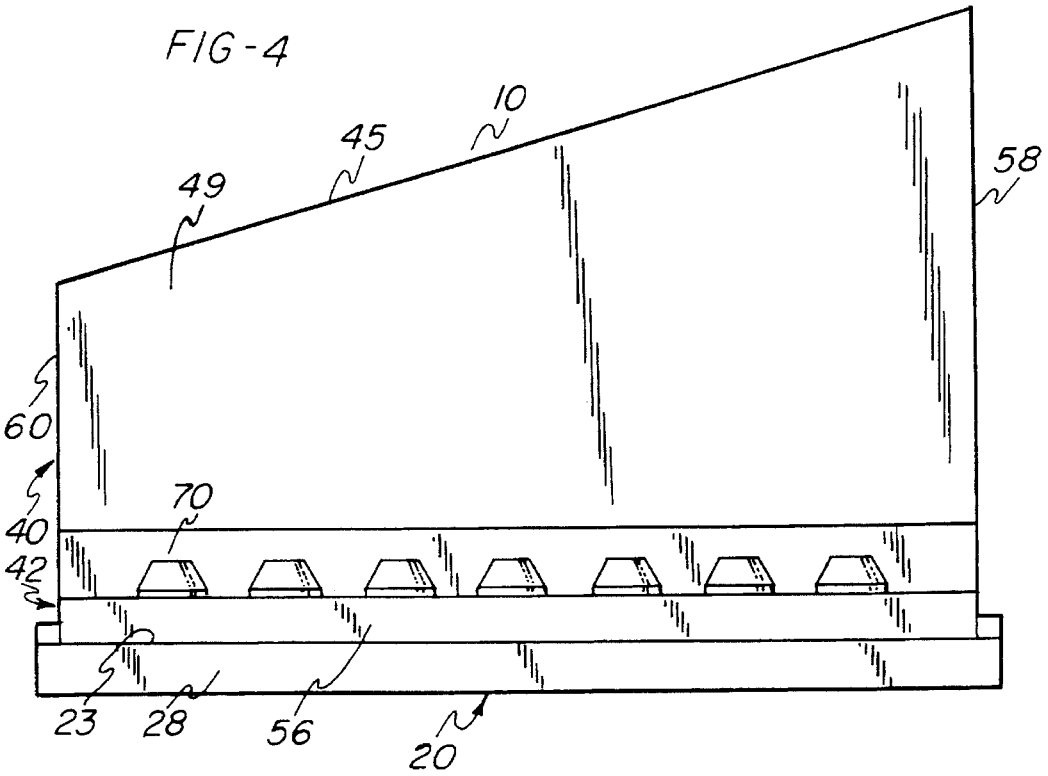
FIG. 4 is a front elevational view of the wingwall of this invention.
Figure 5:
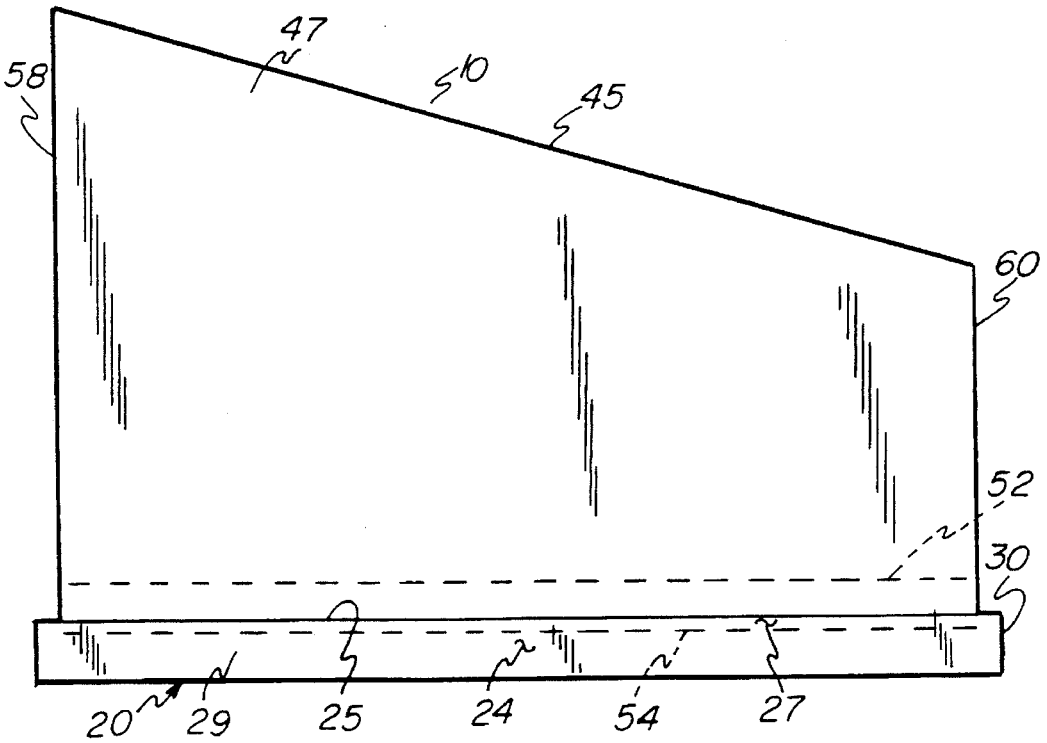
FIG. 5 is a rear elevational view of the wingwall of this invention.

In actual assembly, once the various culvert sections are in place on the central section 19 of the footer, each wingwall 10 has its first end 58 brought adjacent the end section 15 as shown in FIGS. 1 and 2. The end of the precast wingwall is precast to meet the end section 15 of the precast culvert system 12. The various base channels 82 are then aligned with the upright portions 88 of the respective reinforcing rod 85 and the wingwall is lowered into place. Thus it can be appreciated, as shown in FIG. 3, that when the wingwall 10 is lowered into place on the central section 19, the upright portion 88 of each of the reinforcing rods 85 projects through a corresponding base channel 82. Each base channel is approximately 5" in diameter while each cap channel 80 is approximately 1" in diameter. The larger diameter associated with the base channels permits fine adjustment of the wingwall relative to the footer.

When the wingwall is lowered into place, the first face 47 lies directly adjacent side wall 27. Comparing FIGS. 3, 4, and 5 discloses that the bottom surface 54 of the wingwall base portion 42 is positioned lower than the upper surface 25 of the raised portion 24 of the wingwall support portion 22, while the top surface 52 of the wingwall base portion 42 is positioned higher than upper surface 25. This can perhaps best be appreciated from the dashed lines in FIG. 5 which indicate the positions of the bottom surface 54 and top surface 52 of the base portion 42 relative to the upper surface of the raised portion. It should also be noted that the distance between bottom surface 54 and upper surface 25 corresponds to the height of side wall 27 of the raised portion 24.

Before placing the cap onto the base portion 42 of the wingwall, a first substance, preferably cement grout is placed into the base channel 82. As the cement grout fills the base channel 82 around the upright portion 88 of the reinforcing rod 85, some may also seep underneath the wingwall onto the upper surface of the footer. The grout flowing out around the bottom of the wingwall evens inconsistencies which may exist between the wingwall and the poured footer as well as providing yet additional binding support. Additionally, the cement grout inhibits the corrosion of the reinforcing rod if it is of steel. After the base channel 82 is filled, each of the retaining caps 70 is placed over the respective reinforcing rod and each of space between the respective reinforcing rod upright portion 85 and the respective cap channel 80 is filled with an epoxy resin. The epoxy resin or grout typically costs more than the concrete grout. When in place, the first face 47 of the upright portion 40 is adjacent the sidewall 27 of the raised portion 24 of the wingwall section 20 of the footer. The various upright portions of reinforcing rod 85 and the sidewall 27 cooperate to restrain shifting of the wingwall. The cross-section of the reinforcing rod may be of various configurations, including circular and square.

A series of retaining reinforcing rods are placed within the footer, wingwall and retaining cap respectively. The use of such rods in concrete is not new. Typically, the retaining reinforcing rods are a welded wire fabric embedded in the concrete. In conjunction with this invention, footer retaining reinforcing rods 95 are placed as shown within the wingwall section 20 of the footer. Preferably, there are two such footer retaining reinforcing rods, one which extends horizontally across most of the width of the wingwall support section of the footer, and one which extends horizontally across only that portion of the wingwall support section between the base channel 82 and the edge wall 29.

Additionally, wingwall retaining reinforcing rod 97 is placed within the wingwall 10. This wingwall retaining reinforcing rod 97 is actually comprised of a first set of wire 98, a second set of wire 99, and a third set of wire 100. The first set of wire 98 preferably has a vertical component and a horizontal component. The vertical component of the first set of wire 98 in the preferred embodiment of the invention extends parallel to the first face 47, while the horizontal component in the preferred embodiment of the invention extends parallel to the bottom surface 54, as can best be seen in FIG. 3.

Similarly, the second set of retaining wire 99 preferably has a vertical component and a horizontal component. The vertical component of the second set of wire 99 in the preferred embodiment of the invention extends parallel to the second face 49, while the horizontal component in the preferred embodiment of the invention extends parallel to the top surface 52, as can also best be seen in FIG. 3. It will also be appreciated from the drawings that a portion of the second set of wire preferably extends parallel to haunch 65.

The third set of retaining wire 100 is preferably positioned intermediate the first and second sets of retaining wire 98 and 99 respectively. Preferably this third set also has a vertical component and a horizontal component, as well as a sloping component in the area of the haunch, as can be seen in FIG. 3. Finally, the cap retaining wire 102 may either take the form of preferably three circles of wire or a continuous spiral of wire which extends from the lower portions of a cap to near the upper surface 72. It will be appreciated that the forces imposed on the wingwall by soil or other material are transferred to the cast-in-place footer via the reinforcing rods, the retaining caps and any excess grout beneath the base portion.

It will be readily apparent from the foregoing description of the illustrative embodiment of this invention that a particularly novel and extremely effective precast concrete structure is provided. When used as a wingwall, the structure is not affected by settling or shifting of the soil which typically covers the entire footer, base portion of the wingwall, and individual culvert sections with the possible exception of the uppermost top edge 45 and the top of the end wall of the end section 15.

The ability to utilize a precast wingwall will potentially eliminate 1 to 2 weeks construction time. This translates into cost savings as well. Furthermore, since the wingwalls can be fabricated at a single site and then shipped to the point of installation, this permits greater control over the curing process and will insure greater attention to quality control. Those at a job site will not have to be concerned with whether the concrete conforms to certain specifications, since checking for quality control will have already been conducted at the plant and only acceptable wingwalls will be transported to the installation site.

Additionally, vertical cast-in-place wingwalls are relatively more expensive, since the longer exposure subjects the wall to greater risks from potential flooding. Also the walls for cast-in-place projects have to be plumbed, which requires additional time. Furthermore, stronger forms must be used for vertical cast-in-place walls. Still further, if the wall, or a portion thereof, must be aesthetically pleasing, then that requires additional time and labor expense for cast-in-place walls.

The structure may find other uses not requiring culvert sections, such as in landscaping. In such uses the footer would only need to extend under the wingwall support portion of the wingwall. As such, the footer would be formed to approximate a wingwall section as discussed above.

Having thus described this invention, what is claimed is:

1. A precast concrete wingwall comprising an upright portion having a first face and a second face, and a base portion, said base portion having a top surface and a bottom surface, and a plurality of channels of a first diameter extending between said top surface and said bottom surface, said base portion having a width of a first length and said upright portion having a width of a second length, said first length being greater than said second length, said wingwall having a haunch which slopes upwardly from said base portion top surface to said second face.

2. A wingwall according to claim 1 wherein each of said base portion channels is filled with a reinforcing rod and cement grout.

3. A wingwall according to claim 1 which includes a plurality of retaining caps each having a channel of a second diameter extending therethrough, each of said retaining caps positioned above a respective one of said base portion channels.

4. A precast concrete wingwall comprising an upright portion having a first face and a second face, and a base portion, said base portion having a top surface and a bottom surface, and a plurality of channels of a first diameter extending between said top surface and said bottom surface, said base portion having a width of a first length and said upright portion having a width of a second length, said first length being greater than said second length, and a plurality of retaining caps each having a channel of a second diameter extending therethrough, each of said retaining caps positioned above a respective one of said base portion channels.

5. A wingwall according to claim 4 wherein said first diameter is greater than said second diameter.

6. A wingwall according to claim 4 wherein each said retaining cap channel is filled with epoxy resin.

7. A wingwall according to claim 4 wherein said first diameter is greater than said second diameter, each of said base portion channels is filled with a reinforcing rod and cement grout, each said retaining cap channel is filled with a reinforcing rod and epoxy resin, and said upright portion has a first end and a second end, said first end of a height greater than said second end.

8. A precast concrete soil retaining structure for use with a footer having a support portion, the support portion having an upper surface and reinforcing rods extending upwardly therefrom, said structure comprising an upright portion having a first face and a second face, and a base portion, said base portion having a top surface and a bottom surface, a plurality of channels of a first diameter extending between said top surface and said bottom surface, said base portion having a width of a first length and said upright portion having a width of a second length, said first length being greater than said second length.

9. The concrete structure according to claim 8 wherein each of said base portion channels is filled with a reinforcing rod and cement grout.

10. The concrete structure according to claim 8 which includes a plurality of retaining caps each having a channel of a second diameter extending therethrough, each of said retaining caps positioned above a respective one of said base portion channels.

11. The concrete structure according to claim 10 wherein said first diameter is greater than said second diameter.

12. The concrete structure according to claim 10 wherein said first diameter is greater than said second diameter, each of said base portion channels is filled with a reinforcing rod and cement grout, each said retaining cap channel is filled with a reinforcing rod and epoxy resin, and said upright portion has a first end and a second end, said first end of a height greater than said second end.

13. The concrete structure according to claim 10 wherein one each of the reinforcing rods extends through one of said base portion channels and one each of said retaining cap channels.

14. The concrete structure according to claim 8 wherein said upright portion has a first end and a second end, said first end of a height greater than said second end.

15. The concrete structure according to claim 8 which includes a haunch which slopes upwardly from said base portion top surface to said second face.

16. In combination a precast concrete wingwall and a footer said footer comprising a wingwall support portion, a raised portion, and a footer sidewall, said wingwall support portion, having an upper surface and a plurality of reinforcing rods extending upwardly therefrom, said raised portion having an upper surface, said footer side wall extending upwardly from said wingwall support portion to said raised portion, and said wingwall comprising an upright portion having a first face and a second face, and a base portion, said base portion having a top surface and a bottom surface, and a plurality of channels of a first diameter extending between said top surface and said bottom surface, said base portion having a width of a first length and said upright portion having a width of a second length, said first length being greater than said second length.

17. A wingwall according to claim 16 which includes a plurality of retaining caps each having a channel of a second diameter extending therethrough, each of said retaining caps positioned above a respective one of said base portion channels.

18. A wingwall according to claim 17 wherein said first diameter is greater than said second diameter.

19. The concrete structure according to claim 16 which includes a haunch which slopes upwardly from said base portion top surface to said second face.

20. A wingwall according to claim 17 wherein said first diameter is greater than said second diameter, each of said base portion channels is filled with a reinforcing rod and cement grout, each said retaining cap channel is filled with _a reinforcing rod and epoxy resin, and said upright portion has a first end and a second end, said first end of a height greater than said second end.

* * * * *